US011376755B2

(12) United States Patent
Fingold

(10) Patent No.: US 11,376,755 B2
(45) Date of Patent: Jul. 5, 2022

(54) HAIR CUTTING ASSEMBLY AND ASSOCIATED METHOD

(71) Applicant: Elizabeth Fingold, San Francisco, CA (US)

(72) Inventor: Reuben Fingold, San Francisco, CA (US)

(73) Assignee: Elizabeth B. Fingold, San Francisco, CA (US)

( * ) Notice: Subject to any disclaimer, the term of this patent is extended or adjusted under 35 U.S.C. 154(b) by 267 days.

(21) Appl. No.: 15/257,988

(22) Filed: Sep. 7, 2016

(65) Prior Publication Data

US 2018/0065261 A1 Mar. 8, 2018

(51) Int. Cl.

| | |
|---|---|
| ***B26B 21/12*** | (2006.01) |
| ***A45D 24/04*** | (2006.01) |
| ***A45D 24/10*** | (2006.01) |
| ***B26B 21/38*** | (2006.01) |
| ***B26B 21/40*** | (2006.01) |
| ***B26B 21/14*** | (2006.01) |

(52) U.S. Cl.

CPC ..... *B26B 21/12* (2013.01); *A45D 24/04* (2013.01); *A45D 24/10* (2013.01); *B26B 21/14* (2013.01); *B26B 21/38* (2013.01); *B26B 21/4081* (2013.01)

(58) Field of Classification Search

CPC ..... A45D 24/04; A45D 24/10; B26B 21/12; B26B 21/405; B26B 21/4012; B26B 21/125; B26B 21/14; B26B 21/16; B26B 21/165; B26B 21/18; B26B 21/42; B26B 19/00; B26B 19/20; B26B 19/22

USPC ..... 30/194, 195, 231, 232, 233, 233.5, 266, 30/270

See application file for complete search history.

(56) References Cited

U.S. PATENT DOCUMENTS

| | | | | | |
|---|---|---|---|---|---|
| 1,395,334 | A | * | 11/1921 | Behrman | B26B 21/08 30/30 |
| 1,879,961 | A | * | 9/1932 | Thompson | B26B 21/54 30/346.5 |
| 2,138,063 | A | * | 11/1938 | Hotson | B26B 21/18 30/346.61 |
| 2,536,485 | A | * | 1/1951 | Behr | B26B 21/12 30/30 |
| 4,064,977 | A | | 12/1977 | Taylor | |
| 4,663,841 | A | | 5/1987 | Custer | |
| 5,519,939 | A | * | 5/1996 | Smith | B26B 21/12 30/123 |

(Continued)

*Primary Examiner* — Phong H Nguyen

(74) *Attorney, Agent, or Firm* — Debora Plehn-Dujowich; Eckert Seamans Cherin & Mellott, LLC

(57) ABSTRACT

A hair cutter has a base comb with a plurality of base teeth and a supporting comb spaced from said base comb having a plurality of elongated supporting teeth extending to a lesser extent than the base teeth. A cutter blade, which may be adjustable, is secured on the supporting comb side of the base comb in spaced relationship with respect to the base comb with a cutting edge extending in the first direction to a greater extent than the supporting teeth, but to a lesser extent than the base teeth. The hair cutter is structured to have the base teeth and support teeth engaging a portion of the body with progressive movement of the hair cutter serving to effect cutting of the hair to the desired length. The cutter blade may be caused to vibrate by a suitable vibrating motor energized by a battery.

4 Claims, 7 Drawing Sheets

(56) References Cited

U.S. PATENT DOCUMENTS

| | | | |
|---|---|---|---|
| 6,079,103 | A | 6/2000 | Melton et al. |
| 6,427,337 | B1 | 8/2002 | Burks |

* cited by examiner

HAIR CUTTING ASSEMBLY AND ASSOCIATED METHOD

BACKGROUND OF THE INVENTION

1. Field of the Invention

The present invention relates to an improved handheld hair cutter structured to be employed in cutting the hair on a member of the animal kingdom and to an associated method.

2. Description of the Prior Art

It has been known that in the hands of skilled individuals, such as barbers, beauticians, and hair stylists, and using scissors and a comb one may cut the hair on the head of a member of the animal kingdom, such as a human being, to achieve the desired length and style.

Various forms of razor blade-containing shaving and hair trimming devices have been known. U.S. Pat. No. 4,663,841 discloses a handheld, unpowered, razor blade-type hair trimmer.

It has also been known to employ electrically-energized shavers and hair cutting devices. See generally U.S. Pat. Nos. 6,079,103; 6,427,337 and 6,622,385.

U.S. Pat. No. 4,065,977 discloses a vibratory drive with an electric motor for achieving reciprocating vibratory movement for use in shaving heads.

In spite of the foregoing known systems, there remains a very real and substantial need for an improved form of handheld cutter which can be used to trim hair on the body.

SUMMARY OF THE INVENTION

The present invention has met the above-described need by providing a handheld hair cutter having a base comb with a plurality of elongated base teeth extending in a first direction and a supporting comb spaced from the base comb having a plurality of elongated supporting teeth extending generally in the first direction to a lesser extent than the base teeth. A cutter blade extends generally in the first direction secured on the supporting comb side of the base comb in spaced relationship with the base comb. The cutter blade has a cutting edge facing generally in the first direction and extending to a greater extent than the supporting comb teeth, but to a lesser extent than the base comb teeth.

The cutter preferably has a handle to facilitate manual engagement by the user and is structured such that the free ends of the supporting teeth and base teeth may be simultaneously engaged with the body during the cutting operation as the cutter is moved progressively along the body in the region where the hair is to be cut. The supporting teeth are preferably disposed closer to the body than the base teeth during the cutting operation.

In another embodiment, additional combs having teeth extending generally in a first direction are provided.

A corresponding method is provided, wherein the cutter is positioned with the free ends of the supporting teeth and base teeth engaged with the portion of the body, such as the human head, to be cut and preferably is positioned such that the base teeth are oriented at an angle of about 25 degrees to 45 degrees as the cutter is moved manually, preferably downwardly, along the region having the hair to be cut. The cycle of operation is then repeated on other portions of the body.

In a preferred embodiment, the blade may be adjusted with respect to the base comb and support comb.

In another embodiment of the present invention, an electrically-energized vibrating motor causes the blade to vibrate.

It is an object of the present invention to provide an efficient, handheld hair cutter which may be used effectively by those who are semi-skilled or unskilled in the art of hair cutting.

It is a further object of the invention to provide such a construction, which may be employed by individuals to cut regions of their own hair.

It is a further object of the present invention to provide such a hair cutter, which is easy to engage manually, is lightweight, and economical to manufacture.

It is yet another object of the present invention to provide such a hair cutter, wherein the cutting blade may be caused to vibrate during use.

It is yet another object of the present invention to provide such a hair cutter, wherein it may efficiently cut hair on the head of a human being to varying lengths depending upon the position of the blade and angle at which the hair cutter is held with respect to the underlying body portion.

These and other objects of the invention will be more fully understood from the following detailed description of the invention on reference to the illustrations appended hereto.

DESCRIPTION OF THE PREFERRED EMBODIMENTS

As employed herein, the term "member of the animal kingdom" shall broadly include all members of the animal kingdom, including human beings.

Figure 1:
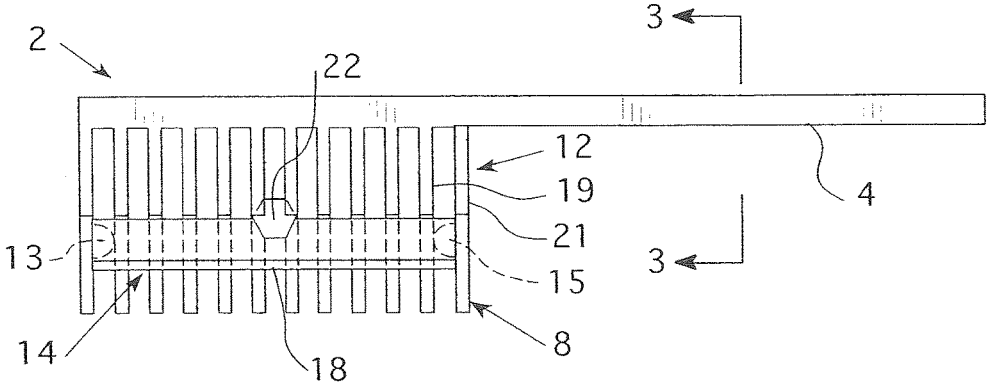
FIG. 1 is a front elevational view of a first embodiment of the hair cutter of the present invention.
Figure 2:
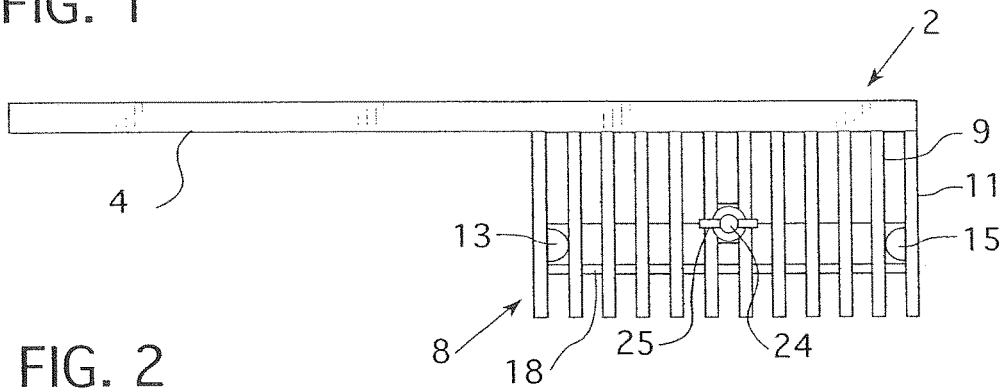
FIG. 2 is a rear elevational view of the hair cutter of FIG. 1.
Figure 3:
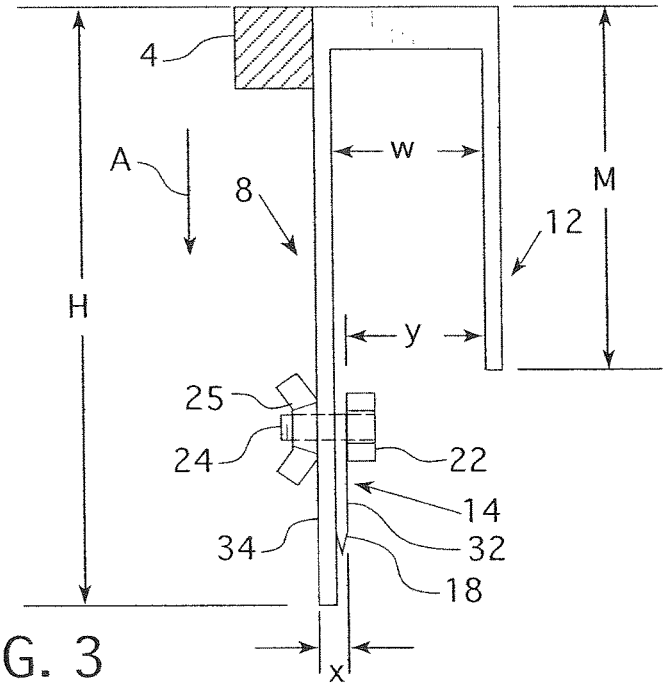
FIG. 3 is a cross-sectional illustration through 3-3 of the hair cutter of FIG. 1.
Figure 4:
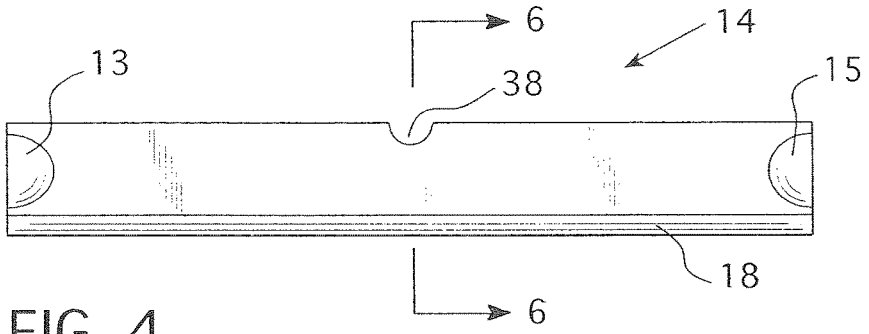
FIG. 4 is a front elevational view of a blade having stabilizer nubs employable in the present invention.

Referring to FIGS. 1 through 3, there is shown a hair cutter 2 of the present invention having an elongated handle 4. A base comb 8 has a plurality of elongated base teeth, such as 9, 11, extending in a first direction, which is indicated by arrow A in FIG. 3. Spaced from the base comb 8 is a supporting comb 12 having supporting teeth, such as 19, 21, extending generally in first direction A. A cutter blade 14 is positioned generally on the supporting comb 12 side of the base comb 8 and extends generally in the first direction A terminating in a lower cutting edge 18. In the form as shown, the blade 14 has a pair of spaced, rearwardly-projecting stabilizer nubs 13, 15, which engage the comb teeth of base comb 8 and serve to resist undesired blade movement. A threaded bolt 24 having bolt head 22 secures elongated blade 14 between bolt head 22 and base comb 8. A wing nut 25 is threadedly-secured to bolt 24 to secure blade 14 in position. As shown in FIG. 4, blade 14 has an upwardly-open recess 38 through which the threaded shank of the bolt 24 passes. The pair of laterally-spaced stabilizer nubs 13, 15 project rearwardly from blade 14 on opposite sides of threaded bolt 24 and through corresponding openings in blade 14. As the invention primarily is intended to cut hair of significant length, while leaving residual portions of the cut hair, unlike shaving, the blade 14 will have its lower edge 18 spaced from the lower end of base comb 8, but will be adjustable upwardly from the lowermost position illustrated in FIGS. 1 through 3. The wing nut 25 or other mechanical fastener need only be loosened, the blade 14 moved to the desired cutting position and then the wing nut 25 will be tightened.

Referring to FIG. 3, it is preferred that the space W between the inner surface of base comb 8 and the inner surface of supporting comb 12 be about ¼ to ½ inch. It is further preferred that the spacing X between the outer surface of blade 14 and the inner surface 34 of base comb 8 be about 1/16 to ⅛ inch and that the spacing Y between the cutting edge 18 of blade 14 and the inner surface 32 of supporting comb 12 be about ⅜ to 7/16 inch. Further, it is preferred that the height of base comb 8, H, be about 1¼ to 1¾ inch and the height M of supporting comb 12 be about ½ to ¾ inch.

If desired, the handle 4 can be provided of sufficient length to project not only to the left of the cutter combs 8, 12 as shown in FIG. 1, but, in addition, to project to the right or to project solely to the right.

Figure 5:
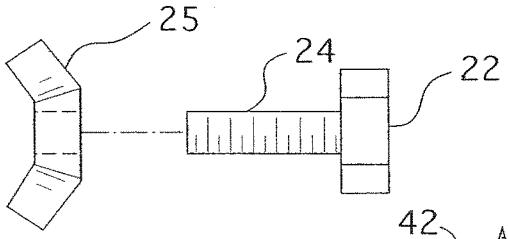
FIG. 5 is an exploded view of a bolt and wing nut employable in the present invention.
Figure 6:
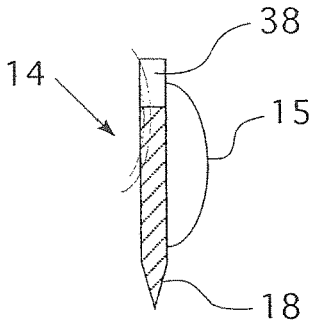
FIG. 6 is a front elevational view of a blade employable in the present invention.
Figure 9:
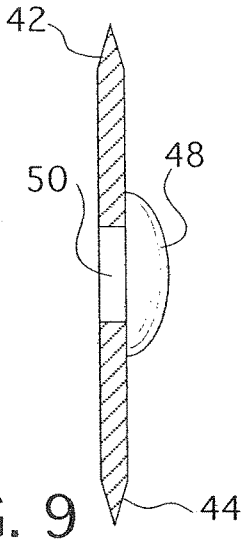
FIG. 9 is a cross-sectional view of the blade of FIG. 7 taken through 8-8.

FIGS. 4 and 6 show the elongated blade 14 which has an upwardly-open recess passage of threaded bolt 24 therethrough and spaced stabilizer nubs 13, 15. FIG. 5 shows an exploded view of the wing nut 25 and the threaded bolt 24 which is structured to be threadedly received therein to secure the assembly.

Figure 7:
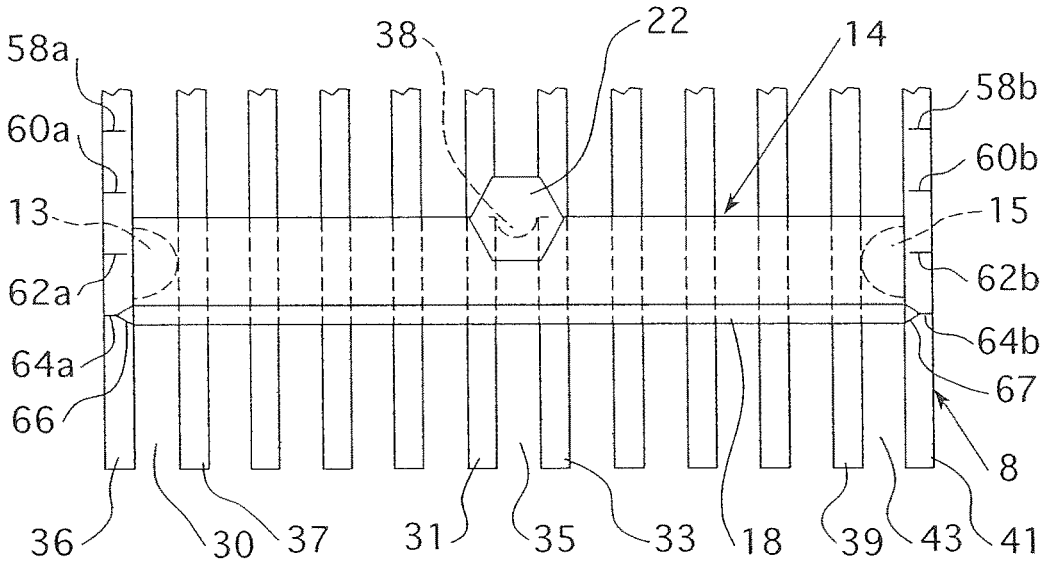
FIG. 7 is a partial front elevational view showing an embodiment having measuring markings.

Referring to FIG. 7, there is shown a blade 14 secured to the base comb 8 by the belt 24 and wing nut 25 with only the bolt head 22 shown in this view. The bolt is partially received within blade recess 38, and the nub 13, 15 projects rearwardly respectively in space 30 between teeth 36, 37 and in space 43 between teeth 39, 41. Finally, the bolt shank passes through recess 38, which is disposed in space 35 between teeth 31, 33. The blade has lower cutting edge 18.

Figure 8:
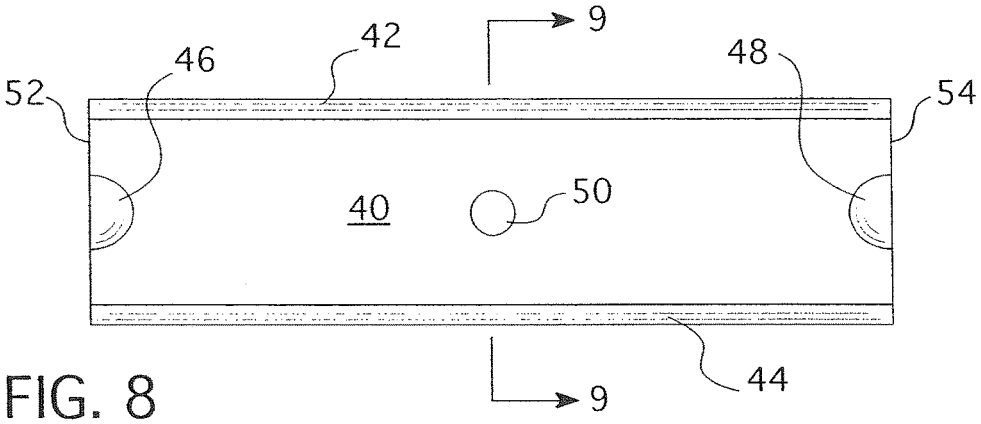
FIG. 8 is an elevational view of the two-edged blade of the present invention.

In FIGS. 7 and 8, there is shown an alternate embodiment, wherein the blade 40 has both upper and lower cutting edges 42, 44, which permit the blade to be removed and rotated 180 degrees when a first edge, such as 44, has become dull and to place the other cutting edge 42 in cutting position. In this embodiment, there is also found an opening 50 through a more central portion of the blade for passage of a bolt shank, such as 24, therethrough with head 22 being in abutting relationship with the blade central portion and a wing nut 25 securing the same to the base comb. On opposite edges 52, 54 of the blade 40 are a pair of rearwardly projecting nubs 46, 48, which are structured to engage base comb teeth for stability and may be of sufficiently small size as to extend at least partially between the pair of adjacent teeth of the base comb 8.

Also shown in FIG. 7 is a series of pairs of dimensional reference lines, such as 58*a*, 58*b*, which are on the same level, or considered another way, the same distance from the lower extremity of the respective teeth 36, 41 on which they appear. Reference lines 60*a* and 60*b*, 62*a* and 62*b*, and 64*a* and 64*b*, as well as any additional desired indicia, may be provided. Also, if desired, the lateral edges of the blade 18 may be provided with pointing projections 66, 67, which enable the user to more effectively determine the position of the blade. This will permit a user to predetermine which settings they prefer the blade for different portions of the hair to be cut.

It will be appreciated, therefore, that the blade, when secured in position, will have the desired cutting edge 18 spacing from the lower end of base comb 8 so as to achieve the desired length of cutting of the hair in a particular location. The vertical adjustability permits adjustment according to the desired amount of cutting to be done and amount of residual hair to be left uncut.

Figure 10:
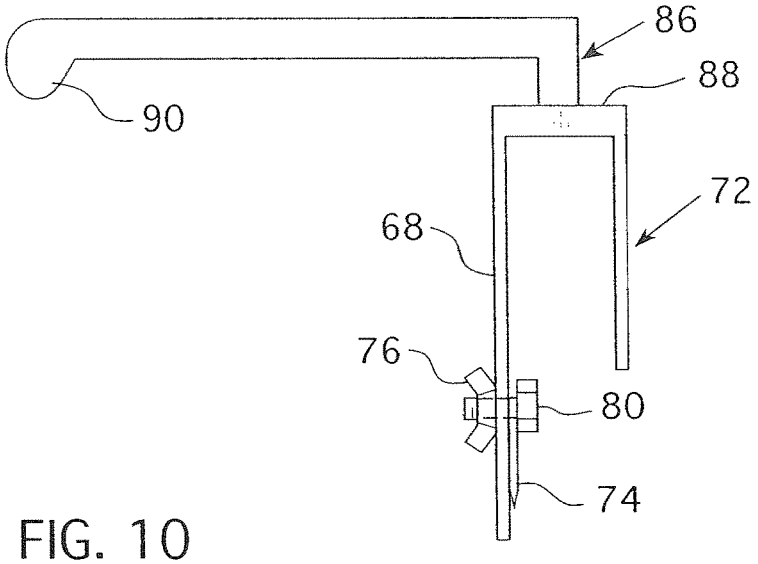
FIG. 10 is an end elevational view of an embodiment of the hair cutter having a modified handle.

FIG. 10 shows a modified form of handheld cutter, wherein the base comb 68 and supporting comb 72 have the blade 74 secured between bolt 80 and base comb 68 by wing nut 76. The assembly is secured in form shown by wing nut 76 and stabilizer nubs (not shown) on opposite sides thereof. The handle 86 in this embodiment projects upwardly and rearwardly from the comb top connector 88 as contrasted with the lateral extent of handle 4 in the embodiment shown in FIGS. 1 and 2. The handle 86 may be substantially coextensive in width with the base comb 68. The handle 86 terminates in an enlarged rib 90 to facilitate gripping. The hair cutter may be operating in essentially the same manner as the first embodiment.

Figure 11:
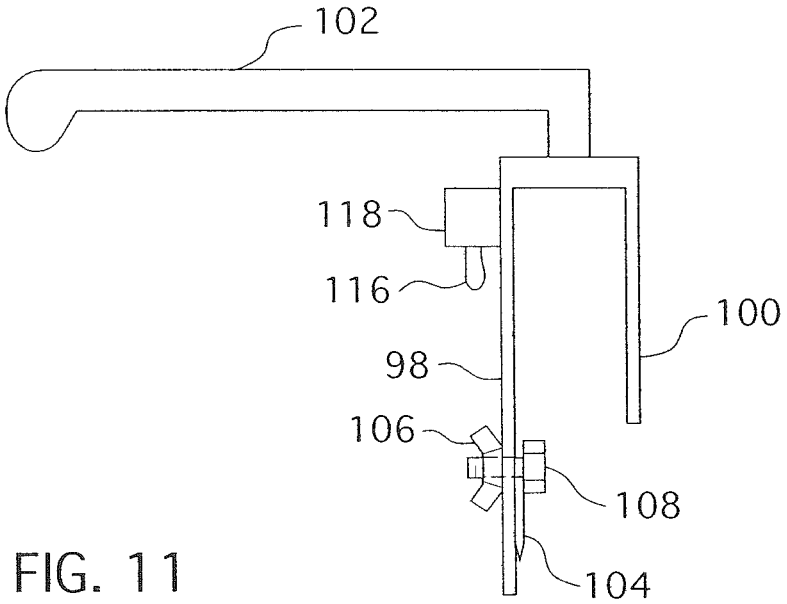
FIG. 11 shows an end elevational view of an embodiment of the hair cutter having a vibrating motor secured thereto.
Figure 12:
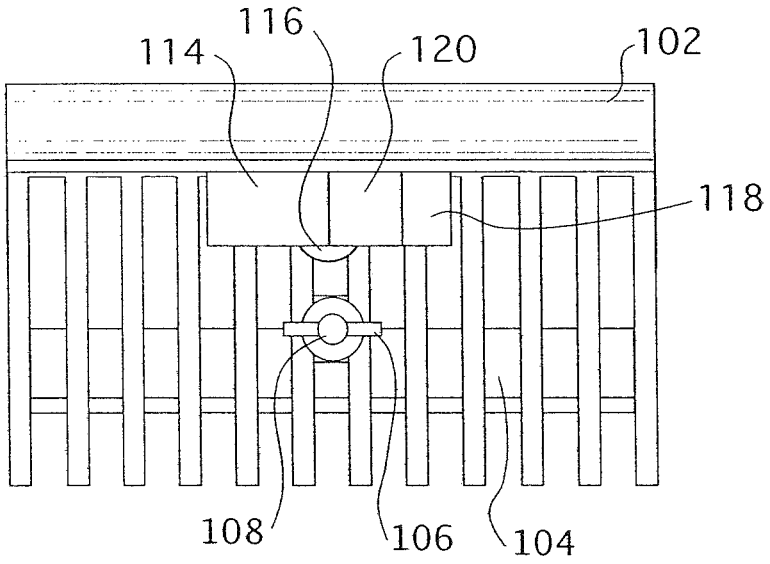
FIG. 12 is a rear elevational view of the hair cutter of FIG. 11.

Referring to FIGS. 11 and 12, in this embodiment, a hair trimmer has a base comb 98, a supporting comb 100, an upwardly and rearwardly extending handle 102 and a blade 104 secured adjacent to base comb 98, and a wing nut 106 along with stabilized nubs projecting rearwardly from blade 104 to assist with control of the extent of cutting of the hair. In this embodiment, a vibrating motor 114 is connected by an electrically-conductive wire 116 to a switch 118, which has a battery 120 operatively associated therewith. When the switch is in the "on" position, the motor 114, which is operatively associated with the blade 104, will cause the blade 104 to vibrate so as to enhance the efficiency of the hair cutting operation.

Figure 13:
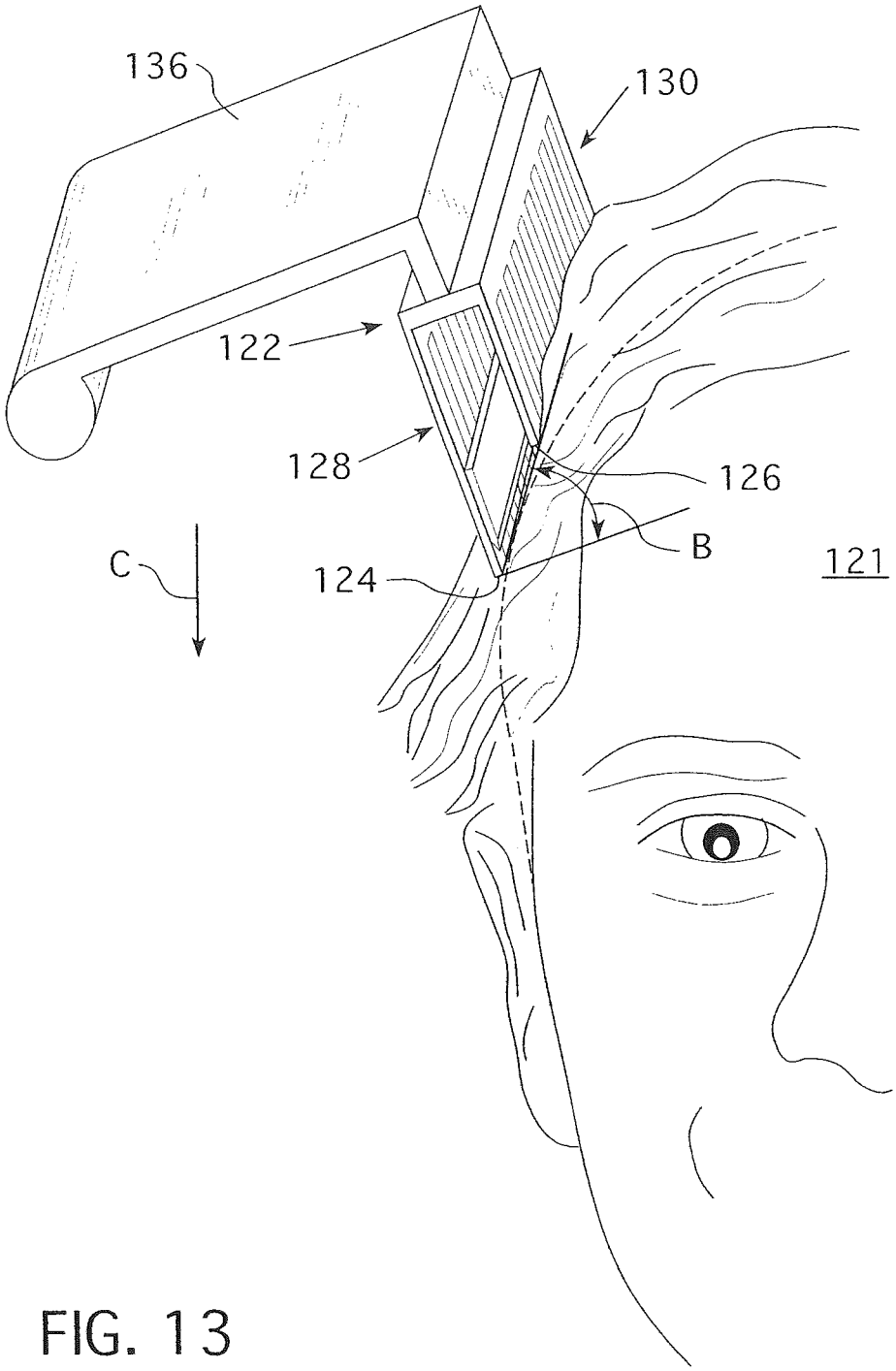
FIG. 13 is a perspective view of a hair cutter of the present invention positioned against the head of a human being.

Referring to FIG. 13, in effecting cutting employing the device of the present invention on the head 121 of a human being, the cutter 122 is held at an angle B with respect to the portion of the body having its hair trimmed. The angle B will preferably be in the range of about 25 degrees to 45 degrees. In the act of cutting, both the free ends 124, 126 of the respective base comb 128 and support comb 130 are closely adjacent to or engaged with the portion of the body being cut with the handheld cutter 122 being moved progressively in the general direction indicated by arrow C. After the lowermost portion of the head 121 has been trimmed with the hair cutter 122, the process is repeated in the next area to be trimmed.

Figure 14:
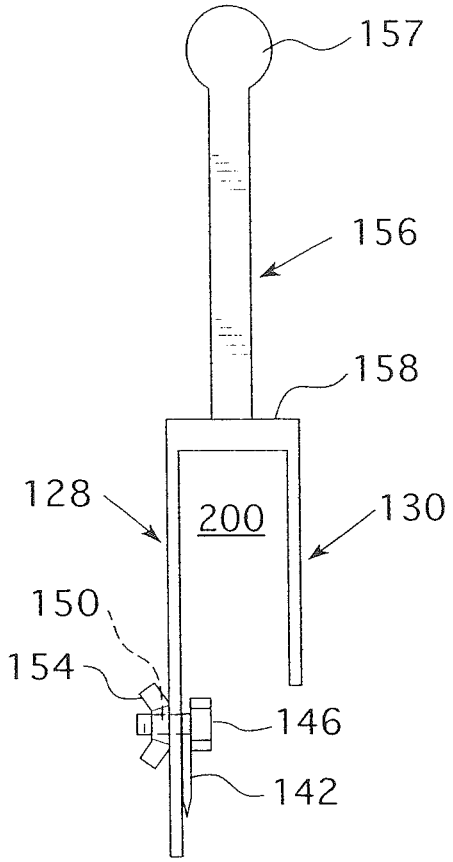
FIG. 14 is an end elevational view of an embodiment of the present invention having the modified handle.

It will be appreciated that while in the preferred illustrated form, the shorter support comb 130 is shown closer to the body than the base comb 128, and for some purposes, it may be desirable to place the support comb 128 closer to the head. To facilitate such flexibility, if desired, the cutter may be designed with the handle 136 extending generally vertically so as to permit ease of manual engagement regardless of the relative orientation of the combs 128, 130 with respect to the portion of the body having the hair cut. Such a construction is shown in FIG. 14, wherein combs 128, 130 have the blade 142 secured adjacent comb 128, threaded bolt 150 having bolt head 146, and wing nut 154. Handle 156 projects generally upwardly and terminates in an enlargement 157 to facilitate the ease of gripping. The handle emerges from top surface 158 and may be formed unitarily therewith or separately and secured thereto so as to establish a unitary structure.

Figure 15:
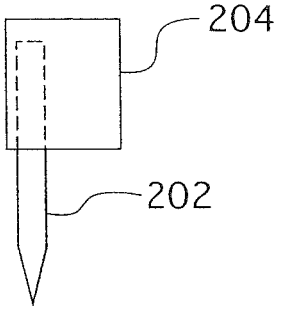
FIG. 15 shows an end elevational view of a cartridge form of blade securement suitable for use with a recess-defining haircutter, such as is shown in FIG. 14.

It will be appreciated that preferred embodiments of the invention showing mechanical securement of the blade at a position spaced from the lower extremity of the longer comb, the securement being achieved by a mechanical fastener, has been disclosed. If desired, the blade may be provided in a housing with the blade projecting therefrom such that the housing may be friction-fit into the inverted channel defined by the two combs and the connecting upper portion, such as, for example, in FIG. 14, the combs 128 and 130 and the comb top connector 158 defining a recess 200 within which blade, such as 202 in FIG. 15, is secured offset from transverse center of the blade housing 204, such that snapping the same into recess 200 will result in effective frictional retention while permitting ready withdrawal for blade replacement. This would be in lieu of the cutter and blade elements 142, 146, 150, 154 shown in FIG. 14.

Figure 16:
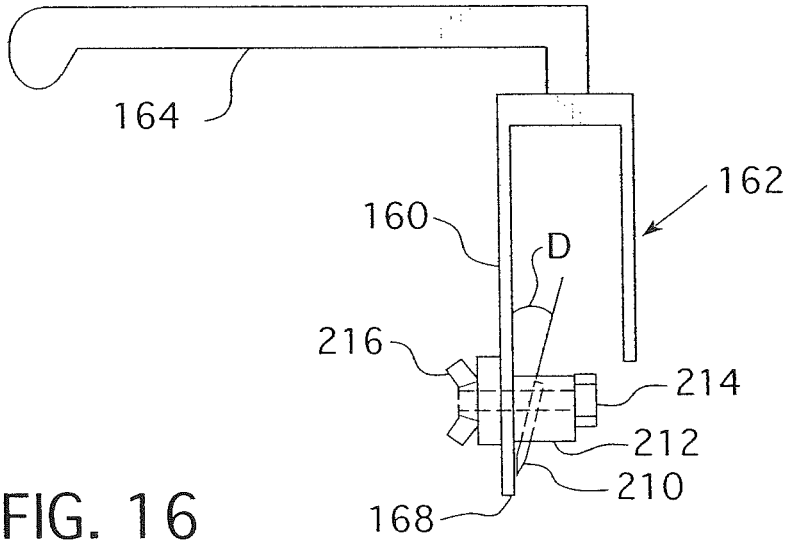
FIG. 16 is an end elevational view of the cutter of the present invention employing a modified cartridge.

Referring to FIG. 16, there is shown a modified form of the invention, wherein a support comb 160 cooperates with a base comb 162 and a handle 164 to support the blade 166 at a position spaced upwardly from the lower end 168 of the teeth of the support comb 160. In this embodiment, the blade 166 is positioned angularly downwardly toward the support comb 160 at an angle D, which preferably may be about 5 degrees to 20 degrees. The blade 210 in that position with the threaded stud 214 passing through the blade 210 and housing 212 with securement being effected by wing nut 216.

It will be appreciated that the cutter may be made of any suitable material with the general preference for the combs which may be formed as a unitary, inverted, channel-type construction being made of a metal or a suitable plastic, the blade being metal and the fasteners being metal or a suitable plastic. In respect of metal, any suitable stainless steel, aluminum, or steel material may be employed. Also, other forms of mechanical blade retention may be employed.

Figure 17:
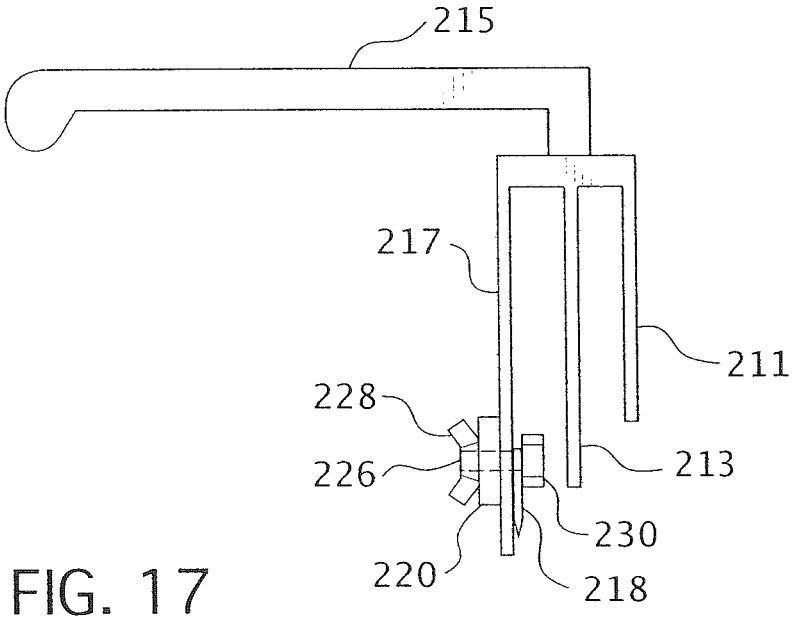
FIG. 17 is an end elevational view of the form of cutter of the present invention having a plurality of combs and being particularly suitable for use in cutting the hair of an animal.

Referring to FIG. 17, there is shown another embodiment of the invention, wherein in addition to support comb 211 and base comb 217, there is an interposed comb 213 spaced generally equally from combs 211, 217. It has a length which is greater than the length of comb 211 and less than the length of comb 217. The assembly has a handle 215 for manual engagement when a cutter is employed. The blade 218 is secured adjacent to the base comb 217 by bolt 226, which has a bolt head 230 and is secured to wing nut 228 with spacer plate 220 being interposed. This form of cutter may advantageously be employed to effect greater control over the hair being cut and may particularly be suited to longer hair, such as might be encountered with animals and some human beings.

Figure 18:
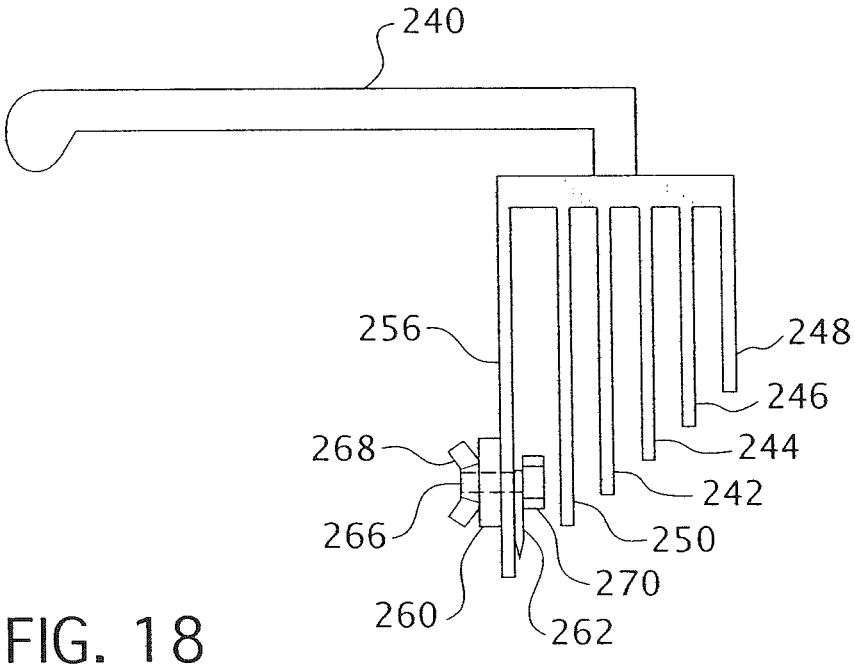
FIG. 18 is an end elevational view of another embodiment of the invention having a plurality of combs.

Referring to FIG. 18, there is shown an assembly similar to that of FIG. 17, but with a total of six combs consisting of support comb 248, intermediate combs 246, 244, 242, 250, and base comb 256. The intermediate combs 246, 244, 242, 250 are generally equally spaced with respect to each other and progressively have lengths greater than the support comb 248 and less than the base comb 256 with the length increasing with each successive comb going from comb 246 to 250. The blade 262 is secured adjacent to base comb 256 by threaded bolt 266, which has bolt head 270 and passes through spacer plate 260 with wing nut 268 effecting the intimate securement.

In the method of the present invention, a hair cutter of the type shown in any of the hereinbefore, previously-described embodiments is manually engaged and is positioned against the portion of the body which is to have its hair cut, such as a human head, for example. It is then moved progressively along the region to trim the hair to the desired length. It will be appreciated that the hair will move between the teeth in the supporting comb as well as the base comb and, depending upon the orientation of the hair cutter with respect to the body portion, will achieve the desired cutting length. The angle may be changed as the hair cutter is moved along the desired path. Leaving the hair cutter on a longitudinal path will effect trimming of the hair for the longitudinal extent of movement across the width of the cutting blade. After completing a desired region of the cutting, the process is then repeated with an adjacent or other desired region which is to be trimmed. It will generally be preferred that the cutter be held in such a fashion that both the base comb 8 and the supporting comb 12 have their free ends 50, 52 in contact with the portion of the body to be cut. Unlike a razor employed for shaving, the cutting edge of the blade may be spaced upwardly from the lower ends of the comb teeth so that only a portion of the hair will be trimmed. Also, the position of the blade may be adjusted.

It will be appreciated that while emphasis has been placed herein on the use of a single blade, the various embodiments may also be employed with two and three or more blades with each of them having appropriate spacers between them.

Whereas particular embodiments of the invention have been described herein for purposes of illustration, it will be evident to those skilled in the art that numerous variations of the details may be made without departing from the invention as set forth in the appended claims.

What is claimed is:

1. A hair cutter comprising a base comb with a plurality of elongated base teeth extending generally in a first direction, a supporting comb spaced from said base comb having a plurality of elongated supporting teeth extending generally in said first direction to a lesser extent than said base teeth, a cutting blade extending generally in said first direction secured on the supporting comb side of said base comb with its cutting edge extending in said first direction to a greater extent than said support teeth, but to a lesser extent than said base teeth, said hair cutter having a unitary manually-engageable handle, said base comb and said supporting comb are connected by an integrally formed comb top connector to establish said unitary structure, said base comb, supporting comb and comb top connector defining a downwardly open recess within which said cutting blade is received, said base comb having a plurality of markings to facilitate desired positioning of said blade in multiple positions, said cutting blade secured to said base comb, said base comb being spaced about ¼ to ½ inch from said supporting comb, said cutter being structured to cut the hair on the head of a human being, and said cutter being, structured to have said support teeth disposed closer to said human head than said base teeth during cutting.

2. The hair cutter of claim 1 including said blade being fixedly secured to said base comb by a threaded mechanical fastener passing through said base comb and a cooperating nut threadedly engaged with said threaded mechanical fastener.

3. The hair cutter of claim 2 including said mechanical fastener and said nut being structured to be loosened to permit adjustment of said cutting blade position with respect to said base comb.

4. The hair cutter of claim 2 including said blade having a pair of relatively spaced integrally formed stabilizing nubs disposed at the ends of the blades with said mechanical fastener disposed therebetween, and each said nub engaging a gap between two teeth of said base comb.

* * * * *